US006336092B1

(12) United States Patent
Gibson et al.

(10) Patent No.: US 6,336,092 B1
(45) **Date of Patent: *Jan. 1, 2002**

(54) TARGETED VOCAL TRANSFORMATION

(75) Inventors: Brian Charles Gibson, Victoria; Peter Ronald Lupini, North Saanich; Dale John Shpak, Victoria, all of (CA)

(73) Assignee: Ivl Technologies Ltd (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/848,050

(22) Filed: Apr. 28, 1997

(51) Int. Cl.[7] ..... G10L 13/06; G10L 11/04

(52) U.S. Cl. ..... 704/268; 704/207; 704/264; 704/269

(58) Field of Search ..... 704/276, 207, 704/209, 278, 265, 200, 203, 205, 208, 213, 214, 270, 266, 267, 268, 269; 84/602, 603

(56) References Cited

U.S. PATENT DOCUMENTS

| | | | | | |
|---|---|---|---|---|---|
| 3,539,701 | A | | 11/1970 | Milde | 84/1.28 |
| 3,600,516 | A | * | 8/1971 | King | 704/207 |
| 3,929,051 | A | | 12/1975 | Moore | 84/1.17 |
| 3,986,423 | A | | 10/1976 | Rossum | 84/1.01 |
| 3,999,456 | A | | 12/1976 | Tsunoo et al. | 84/1.01 |
| 4,004,096 | A | * | 1/1977 | Bauer et al. | 704/207 |
| 4,076,960 | A | | 2/1978 | Buss et al. | 179/1 |
| 4,081,607 | A | | 3/1978 | Vitols et al. | 179/1 |
| 4,142,066 | A | | 2/1979 | Ahamed | 179/1 |
| 4,279,185 | A | | 7/1981 | Alonso | 84/1.01 |
| 4,311,076 | A | | 1/1982 | Rucktenwald et al. | 84/1.03 |
| 4,387,618 | A | | 6/1983 | Simmons, Jr. | 84/1.03 |
| 4,464,784 | A | | 8/1984 | Agnello | 381/61 |
| 4,508,002 | A | | 4/1985 | Hall et al. | 84/1.03 |
| 4,519,008 | A | | 5/1985 | Takenouchi et al. | 360/79 |
| 4,561,102 | A | * | 12/1985 | Prezas | 704/207 |
| 4,596,032 | A | | 6/1986 | Sakurai | 381/51 |
| 4,688,464 | A | | 8/1987 | Gibson et al. | 84/454 |
| 4,771,671 | A | | 9/1988 | Hoff, Jr. | 84/1.01 |

(List continued on next page.)

FOREIGN PATENT DOCUMENTS

| | | | | |
|---|---|---|---|---|
| EP | 0 504 684 A3 | | 9/1992 | G10H/5/00 |
| GB | 2 087 123 A | | 5/1982 | G10H/7/00 |
| GB | 2 094 053 A | | 9/1982 | G10H/1/32 |
| JP | 403007995 | * | 6/1989 | 704/266 |
| JP | 406250695 | * | 2/1993 | 704/207 |
| WO | 90/03640 | | 4/1990 | G10H/7/00 |
| WO | 90/13887 | | 11/1990 | G10H/1/057 |
| WO | 93/18505 | | 9/1993 | G10L/3/02 |

OTHER PUBLICATIONS

Robert Bristow–Johnson, "A Detailed Analysis of a Time-Domain Formant–Corrected Pitch–Shifting Algorithm," *Fostex Research and Development, Inc.*, J. Audio Eng. So., vol. 43, No. 5, May 1995, pp. 340–352.

(List continued on next page.)

*Primary Examiner*—William Korzuch
*Assistant Examiner*—Abul K. Azad
(74) *Attorney, Agent, or Firm*—Wilson Sonsini Goodrich & Rosati

(57) ABSTRACT

The invention is a method for transforming a source individual's voice so as to adopt the characteristics of a target individual's voice. The excitation signal component of the target individual's voice is extracted and the spectral envelope of the source individual's voice is extracted. The transformed voice is synthesized by applying the spectral envelope of the source individual to the excitation signal component of the voice of the target individual. A higher quality transformation is achieved using an enhanced excitation signal created by replacing unvoiced regions of the signal with interpolated data from adjacent voiced regions. Various methods of transforming the spectral characteristics of the source individual's voice are also disclosed.

39 Claims, 8 Drawing Sheets

U.S. PATENT DOCUMENTS

| | | | | | |
|---|---|---|---|---|---|
| 4,802,223 | A | | 1/1989 | Lin et al. | 381/38 |
| 4,915,001 | A | | 4/1990 | Dillard | 84/600 |
| 4,991,218 | A | | 2/1991 | Kramer | 381/61 |
| 4,991,484 | A | | 2/1991 | Kawashima | 84/603 |
| 4,995,026 | A | | 2/1991 | Makabe et al. | 369/70 |
| 5,005,204 | A | | 4/1991 | Deaett | 381/51 |
| 5,048,390 | A | | 9/1991 | Adachi et al. | 84/464 |
| 5,054,360 | A | | 10/1991 | Lisle et al. | 84/645 |
| 5,056,150 | A | * | 10/1991 | Yu et al. | 381/43 |
| 5,092,216 | A | * | 3/1992 | Wadhams | 84/602 |
| 5,131,042 | A | * | 7/1992 | Oda | 381/34 |
| 5,194,681 | A | * | 3/1993 | Kudo | 84/603 |
| 5,231,671 | A | * | 7/1993 | Gibson et al. | 381/49 |
| 5,301,259 | A | * | 4/1994 | Gibson et al. | 395/2.67 |
| 5,307,442 | A | * | 4/1994 | Abe et al. | 704/270 |
| 5,327,521 | A | * | 7/1994 | Savic et al. | 704/272 |
| 5,369,725 | A | * | 11/1994 | Iizuka et al. | 704/207 |
| 5,428,708 | A | * | 6/1995 | Gibson et al. | 704/270 |
| 5,536,902 | A | | 7/1996 | Serra et al. | 84/623 |
| 5,567,901 | A | * | 10/1996 | Gibson et al. | 84/603 |
| 5,641,926 | A | * | 6/1997 | Gibson et al. | 84/603 |
| 5,644,677 | A | | 7/1997 | Park et al. | 395/2.16 |
| 5,750,912 | A | | 5/1998 | Matsumoto | 84/609 |
| 5,765,127 | A | * | 6/1998 | Nishiguchi et al. | 704/208 |

OTHER PUBLICATIONS

Lawrence R. Rabixer et al., "A Comparative Performance Study of Several Pitch Detection Algorithms," *IEEE Transactions on Acoustics, Speech and Signal Processing*, vol. ASSP–24, No. 5, Oct. 1976, pp. 399–418.

Warren Tucker et al., "A Pitch Estimation Algorithm for Speech and Music," *IEEE Transactions on Acoustics, Speech and Signal Processing*, vol. ASSP–26, No. 6, Dec. 1978, pp. 597–604.

Affidavit of Robert Bristow–Johnson dated Feb. 24, 1997.

Letter from Robert Bristow–Johnson to Mark Wachsler dated Feb. 10, 1997.

Affidavit of Russell Pinkston dated Mar. 3, 1997.

Letter from Russell Pinkston to Mr. Mark Wachsler dated Feb. 11, 1997.

Affidavit of Keith Lent dated Mar. 10, 1997.

Letter from Keith Lent to Mark Wachsler dated Feb. 27, 1997.

Letter from Prof. Giovanni De Poli to Mark Wachsler dated Feb. 14, 1997.*

Keith Lent et al., "Accelerando: A Real–Time, General Purpose Computer Music System," *Computer Music Journal*, vol. 13, No. 4, Winter 1989, pp. 54–64.*

K. Nakata, A. Ichikawa, "Speech synthesis for an unlimited vocabulary," Proc. Speech Communication Seminar, vol. 2, 261–266, 1974.*

M. Mezzalama, E. Rusconi, "Intonation in speech synthesis: a preliminary study for the Italian language," idem, pp. 315–325.

W. Endres, E. Grossman, "Manipulation of the time functions of vowels for reducing the number of elements needed for speech synthesis," idem, pp. 267–275.

Lent, K., "An Efficient Method for Pitch Shifting Digitally Sampled Sounds," *Computer Music Journal*, 13: 65–71, No. 1 (Winter 1989).

R. C. Nieberle et al., "CAMP: Computer–Aided Music Processing," *Computer Music Journal*, 15: 33–40, No. 2 (Summer 1991).

W.F. McGee et al., "A Real–Time Logarithmic–Frequency Phase Vocoder," *Computer Music Journal*, 15: 20–27, No. 1 (Spring 1991).

*The Vocalist Vocal Harmony Processor*, product manual of DigiTech, A Harman International Company, DOD Electronics Corporation (1991).

*Vocalist II Vocal Harmony Processor*, product manuel of DigiTech, A Harman International Company, DOD Electronics Corporation (1992).

R. Bristow–Johnson, "A Detailed Analysis of a Time–Domain Formant Correct Pitch Shifting Algorithm," presented at 95th Convention of the AES in New York, 3718 (A1–AM–5): 1–14; Figures 1–9 (Oct. 7–10, 1993).

S. Seneff, "System to Independently Modify Excitation and/or Spectrum of Speech Waveform Without Explicit Pitch Extraction," *IEEE Trns on Acoustics, Speech & Signal Processing*, ASSP–30: 566–578, #4, 8/82.

Mizuno et al., "Voice Conversion Based on Piecewise Linear Conversion Rules of Formant Frequency and Spectrum Tilt," Pro. of ICASSP, Speech Processing 1. Adelaide, Apr. 19–22, 1994, vol. 1, pp. I–469–472, IEEE XP000529420.

G. De Poli et al., "An Effective Software Tool for Digital Filter Design," IEEE, Via Gradenigo 6/A, 35131 Padova—Italy, 1986, pp. 237–243.

* cited by examiner

TARGETED VOCAL TRANSFORMATION

FIELD OF THE INVENTION

This invention relates to the transformation of a person's voice according to a target voice. More particularly, this invention relates to a transformation system where recorded information of the target voice can be used to guide the transformation process. It further relates to the transformation of a singer's voice to adopt certain characteristics of a target singer's voice, such as pitch and other prosodic factors.

BACKGROUND OF THE INVENTION

There are a number of applications where it may be desirable to transform a person's voice (the source vocal signal) into a different person's voice (the target vocal signal). This invention performs such a transformation and is suited to applications where a recording of the target voice is available for use in the transformation process. Such applications include Automatic Dialogue Replacement (ADR) and Karaoke. We have chosen to describe the karaoke application because of the additional demands for accurate pitch processing in such a system but the same principles apply for a spoken-word system.

Karaoke allows the participants to sing songs made popular by other artists. The songs produced for karaoke have the vocal track removed leaving behind only the musical accompaniment. In Japan, karaoke is the second largest leisure activity, after dining out. Some people, however, cannot participate in the karaoke experience because they are unable to sing in the correct pitch.

Often, as part of the karaoke experience, the singer tries to mimic the style and sound of the artist who originally made the recording. This desire for voice transformation is not limited to karaoke but is also important for impersonators who might mimic, for example, Elvis Presley performing one of his songs.

Most of the research in voice transformation has related to the spoken voice as opposed to the sung voice. H. Kuwabara and Y. Sagisaka, Acoustic characteristics of speaker individuality: Control and conversion, *Speech Communication,* vol. 16, 1995 separated the factors responsible for voice individuality into two categories:

- physiological factors (e.g. length of the vocal tract, glottal pulse shape, and position and bandwidth of the formants), and
- socio-linguistic and psychological factors, or prosodic factors (e.g. pitch contour, duration of words, timing and rhythm)

The bulk of the research into voice transformation has focused on the direct conversion of the physiological factors, particularly vocal tract length compensation and formant position/bandwidth transformation. Although it appears to be recognized that the most important factors for voice individuality are the prosodic factors, current speech technologies have not allowed useful extraction and manipulation of the prosodic features and have instead focused on direct mapping of vocal characteristics.

The inventors have found that the important characterizing parameters for successful voice conversion to a specified target depend on the target singer. For some singers, the pitch contour at the onset of notes (for example the "scooping" style of Elvis Presley) is critical. Other singers may be recognized more for the "growl" in their voice (e.g. Louis Armstrong). The style of vibrato is another important factor of voice individuality. These examples all involve prosodic factors as the key characterizing features. While physiological factors are also important, we have found that the transformation of physiological parameters need not be exact in order to achieve a convincing identity transformation. For example it may be enough to transform the perceived vocal-tract length without having to transform the individual formant locations and bandwidths.

SUMMARY OF THE INVENTION

The present invention provides a method and apparatus for transforming the vocal characteristics of a source singer into those of a target singer. The invention relies on the decomposition of a signal from a source singer into excitation and vocal tract resonance components. It further relies on the replacement of the excitation signal of the source singer with an excitation signal derived from a target singer. This disclosure also presents methods of shifting the timbre of the source singer into that of the target singer by modifying the vocal tract resonance model. Additionally, pitch-shifting methods may be used to modify the pitch contour to better track the pitch of the source singer.

According to the invention, the excitation component and pitch contour of the vocal signal of the target singer are first obtained. This is done by essentially extracting the excitation signal and pitch data from the target singer's voice and storing them for use in the vocal transformer.

The invention allows the transformation of voice either with or without pitch correction to match the pitch of the target singer. When used to transform voice with pitch correction, the source singer's vocal signal is converted from analog to digital data, and then separated into segments. For each segment, a voicing detector is used to determine whether the signal contains voiced or unvoiced data. If the signal contains unvoiced data, the signal is sent to the digital to analog converter to be played on the speaker. If the segment contains voiced data, the signal is analyzed to determine the shape of the spectral envelope which is then used to produce a time-varying synthesis filter. If timbre and/or gender shifting or other vocal transformations are also desired, or in cases where doing so will improve the results (e.g., where the spectral shapes of the source and target voices are very different) the spectral envelope may first be transformed, then used to create the time-varying synthesis filter. The transformed vocal signal is then created by passing the target excitation signal through the synthesis filter. Finally, the amplitude envelope of the untransformed source vocal signal is used to shape the amplitude envelope of the transformed source vocal.

When used as a voice transformer without pitch correction, two extra steps are performed. First the pitch of the source vocal is extracted. Then the pitch of the target excitation is shifted using a pitch shifting algorithm so that the target excitation pitch is made to track the pitch of the source vocal.

BRIEF DESCRIPTION OF THE DRAWINGS

The invention may be more fully appreciated by reference to the following description of the preferred embodiments thereof in conjunction with the drawings wherein.

DETAILED DESCRIPTION OF THE BEST MODE AND THE PREFERRED EMBODIMENTS

Figure 1:
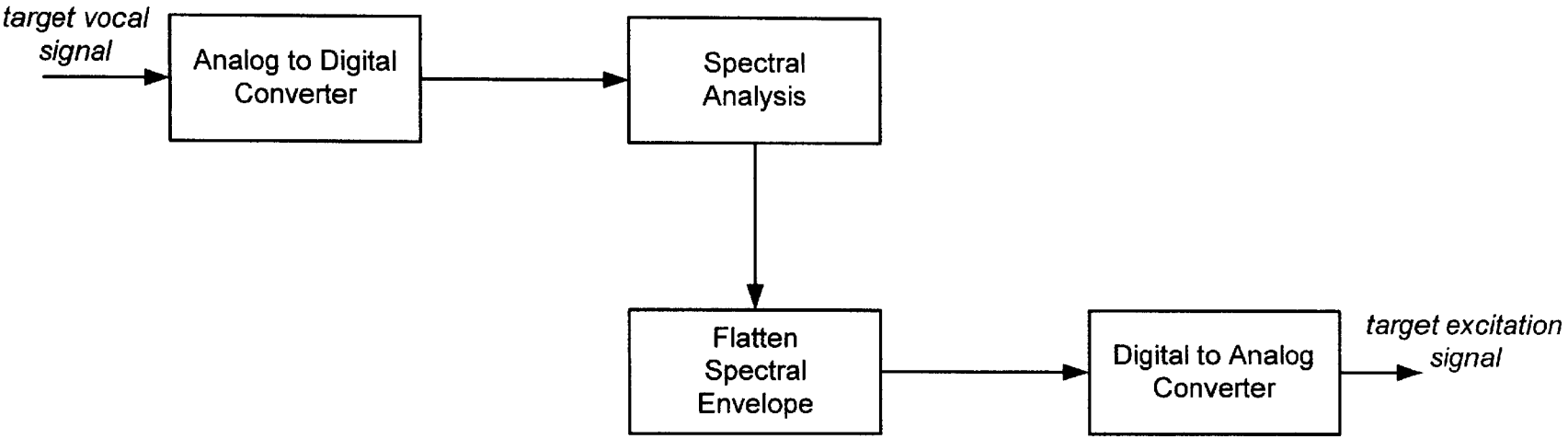
FIG. 1 is a block diagram of a processor used to create a target excitation signal.

Referring to the block diagram of FIG. 1, a target vocal signal is first converted to digital data. This step is, of course, not required if the input signal is already presented in digital format.

The first step is to perform spectral analysis on the target vocal signal. The spectral envelope is determined and used to create a time-varying filter for the purpose of flattening the spectral envelope of the target vocal signal. The method used for performing spectral analysis could employ various techniques from the prior art for generating a spectral model. These spectral analysis techniques include all-pole modeling methods such as linear prediction (see for example, P. Strobach, "*Linear Prediction Theory*", Springer-Verlag, 1990), adaptive filtering (see J. I. Makhoul and L. K. Cosell, "Adaptive Lattice Analysis of Speech," IEEE Trans. Acoustics, Speech, Signal Processing, vol. 29, pp. 654–659, June 1981), methods for pole-zero modeling such as the Steiglitz-McBride algorithm (see K. Steiglitz and L. McBride, "A technique for the identification of linear systems", IEEE Trans. Automatic Control, vol. AC-10, pp. 461–464, 1965), or transform-based methods including multi-band excitation (D. Griffin and J. Lim, "Multiband excitation vocoder", IEEE Trans. Acoustics, Speech, Signal Process., vol. 36, pp. 1223–1235, August 1988) and cepstral-based methods (A. Oppenheim and R. Schafer, "Homomorphic analysis of speech", IEEE Trans. Audio Electroacoust., vol. 16, June 1968). The all-pole or pole-zero models are typically used to generate either lattice or direct-form digital filters. The amplitude of the frequency spectrum of the digital filter is chosen to match the amplitude of the spectral envelope obtained from the analysis.

The preferred embodiment uses the autocorrelation method of linear prediction because of its computational simplicity and stability properties. The target voice signal is first separated into analysis segments. The autocorrelation method generates P reflection coefficients $k_i$. These reflection coefficients can be used directly in either an all-pole synthesis digital lattice filter or an all-zero analysis digital lattice filter. The order of the spectral analysis P depends on the sample rate and other parameters as described in J. Markel and A. H. Gray Jr., *Linear Prediction of Speech.* Springer-Verlag, 1976.

The alternative direct-form implementation for this all-pole method has a time-domain difference equation of the form:

$$y(k) = x(k) - \sum_{i=1}^{P} a(i)y(k-i) \tag{1}$$

where y(k) is the current filter output sample value, x(k) is the current input sample value, and the a(i)'s are the coefficients of the direct-form filter. These coefficients a(i) are computed from the values of the reflection coefficients $k_i$. The corresponding z-domain transfer function for the all-pole synthesis is:

$$H(z) = \frac{1}{1 + \sum_{i=1}^{P} a(i)z^{-i}} \tag{2}$$

The complementary all-zero analysis filter has a difference equation given by:

$$y(k) = x(k) - \sum_{i=1}^{P} a(i)x(k-i) \tag{3}$$

and a z-domain transfer function given by:

$$H(z) = 1 + \sum_{i=1}^{P} a(i)z^{-i} \tag{4}$$

Whether using a lattice, direct-form, or other digital filter implementation, the target vocal signal is processed by an analysis filter to compute an excitation signal having a flattened spectrum which is suitable for vocal transformation applications. For use by a vocal transformer, this excitation signal can either be computed in real time or it can be computed beforehand and stored for later use. The excitation signal derived from the target may be stored in a compressed form where only the information essential to reproducing the character of the target singer are stored.

As an enhancement to the vocal transformer, it is possible to further process the target excitation signal in order to make the system more forgiving of timing errors made by the source singer. For example, when the source singer sings a particular song his phrasing may be slightly different from the target singer's phrasing of that song. If the source singer begins singing a word slightly before the target singer did in his recording of the song there would be no excitation signal available to generate the output until the point where the target singer began the word. The source singer would perceive that the system is unresponsive and would find the delay annoying. Even if the alignment of the words is accurate it is unlikely that the unvoiced segments from the source singer will line up exactly with the unvoiced segments for the target singer. In this case the output would sound quite unnatural if the excitation from an unvoiced portion of the target singer's signal was applied to generate a voiced segment in the output. The goal of this enhanced processing is to extend the excitation signal into the silent region before and after each word in the song and to identify unvoiced regions within the words and provide voiced excitation for those segments.

Figure 2:
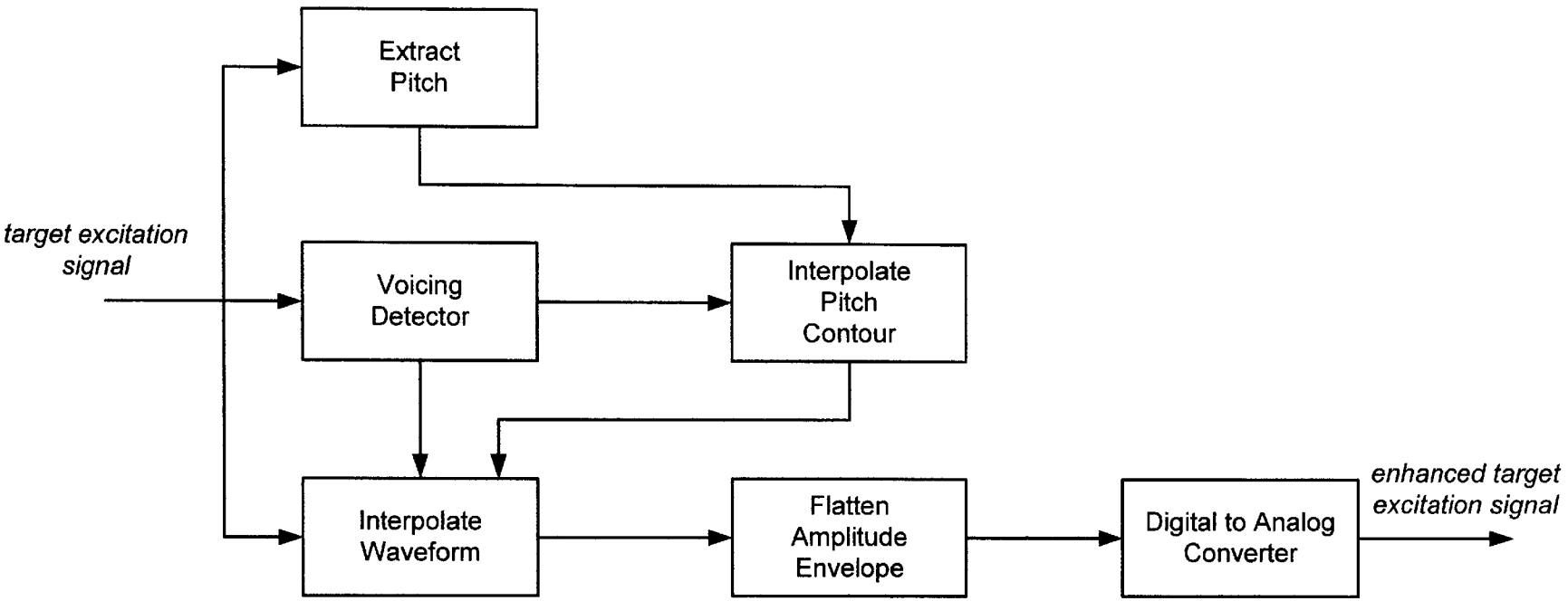
FIG. 2 is a block diagram of a processor used to create an enhanced target excitation signal.

The enhanced excitation processing system is shown in FIG. 2. The target excitation signal is separated into segments which are classified as being either voiced or unvoiced. In the preferred embodiment, voicing detection is accomplished by examining the following parameters: average segment power, average low-band segment power, and zero crossings per segment. If the total average power for a segment is less than a 60 db below the recent maximum average power level, the segment is declared silent. If the number of zero crossings exceeds 8/ms, the segment is declared unvoiced. If the number of zero crossings are less than 5/ms, the segment is declared voiced. Finally, if the ratio of low-band average power to total band average power is less than 0.25, the segment is declared unvoiced. Otherwise it is declared voiced.

For voiced segments, the pitch is extracted. For unvoiced or silent segments, the pitch is set to 0 and the unvoiced data is replaced with silence. The target excitation signal is then analyzed for gaps which are left due to non-voiced regions. The gaps are then filled in with interpolated voiced data from previous and subsequent voiced regions.

There are several ways in which the interpolation can be accomplished. In all cases, the goal is to create an interpolated voiced signal having a pitch contour which blends with the bounding pitch contour in a meaningful way (for example, for singing, the interpolated notes should sound good with the background music). For some applications, the interpolated pitch contour may be calculated automatically, using, for example, cubic spline interpolation. In the preferred embodiment, the pitch contour is first computed using spline interpolation, and then any portions which are deemed unsatisfactory are fixed manually by an operator.

Once a suitable pitch contour is obtained, the gaps in the waveform left due to removal of unvoiced regions must be filled in at the interpolated pitch value. There are several methods for doing this. In one method, the samples from voiced segments prior to the gap are copied across the gap and then pitch shifted using the interpolated pitch contour. In the preferred embodiment, sinusoidal synthesis is used to morph between the waveforms on either side of the gap. Sinusoidal synthesis has been used extensively in fields such as speech compression (see, for example, D. W. Griffin and J. S. Lim, "Multiband excitation vocoder," IEEE Trans. Acoustics, Speech, and Signal Processing, vol. 36, pp. 1223–1235, August, 1988). In speech compression, sinusoidal synthesis is used to reduce the number of bits required to represent a signal segment. For these applications, the pitch contour over a segment is usually interpolated using quadratic or cubic interpolation. For our application, however, the goal is not one of compression, but rather the "morphing" of one sound into another following a pitch contour which is pre-defined (possibly even manually generated by an operator), therefore a new technique has been developed for the preferred embodiment (note that the equations are shown in the continuous time domain for simplicity) as set out below.

Assume that a gap between times $t_1$ and $t_2$ must be filled in via sinusoidal interpolation. First, the pitch contour, w(n), is determined (automatically or manually by an operator). Then spectral analysis using the Fast Fourier Transform (FFT) with peak picking (see, for example, R. J. McAulay and T. F. Quatieri, "Sinusoidal Coding", in Speech Coding and Synthesis, Elsevier Science B.V, 1995) is performed at $t_1$ and $t_2$ to obtain the spectral magnitudes $A_k(t_1)$ and $A_k(t_2)$, and phases $\phi_k(t_1)$ and $\phi_k(t_2)$, where the subscript k refers to the harmonic number. The synthesized signal segment, y(t), can then be computed as:

$$y(t) = \sum_{k=1}^{K} A_k(t)\cos[\theta_k(t)] \tag{5}$$

where K is the number of harmonics in the segment (set to half the length of the number of samples in the longest pitch period of the segment). The model we use for the time varying phase for $t_1 \leqq t \leqq t_2$ is given by:

$$\theta_k(t) = \theta_k(t_1) + k\int_{t=t_1}^{t} [w(t) + r_k(t)]dt + d_k t \tag{6}$$

where $r_k(t)$ is a random pitch component used to reduce the correlation between harmonic phases and thus reduce perceived buzziness, and $d_k$ is a linear pitch correction term used to match the phases at the start and end of the synthesis segment. Using the fact that we want $\theta_k(t_1)=\phi(t_1)$ and $\theta_k(t_2)=\phi(t_2)$ in order to avoid discontinuous phase at the segment boundaries, it can be shown that the smallest possible value for $d_k$ which satisfies this constraint is given by:

$$d_k = \left[v_k T - 2\pi\left[\frac{2\pi v_k T + \pi}{2\pi}\right]\right]\frac{1}{T} \tag{7}$$

where $T=(t_2-t_1)$, and $$v_k = \left[\phi_k(t_2) - \phi_k(t_1) - \int_{t=t_1}^{t} (w(t) + r_k(t))dt\right]\frac{1}{T} \tag{8}$$

The random pitch component, $r_k(t)$, is obtained by sampling a random variable having a variance which is determined for each harmonic by computing the difference between the predicted phase and measured phase for signal segments adjacent to the gap to be synthesized, and setting the variance proportional to this value.

Finally as with the unenhanced excitation extraction described earlier, the amplitude envelope of the target excitation signal is flattened using automatic gain compensation.

The excitation signal can also be a composite signal which is generated from a plurality of target vocal signals. In this manner, the excitation signal could contain harmony, duet, or accompaniment parts. For example, excitation signals from a male singer and a female singer singing a duet in harmony could each be processed as described above. The excitation signal which is used by the apparatus would then be the sum of these excitation signals. The transformed vocal signal which is generated by the apparatus would therefore contain both harmony parts with each part having characteristics (e.g., pitch, vibrato, and breathiness) derived from the respective target vocal signals.

The resulting basic or enhanced target excitation signal and pitch data are then typically stored, usually for later use in a vocal transformer. Alternatively, the unprocessed target vocal signal may be stored and the target excitation signal generated when needed. The enhancement of the excitation could be entirely rule-based or the pitch contour and other controls for generating the excitation signal during silent and unvoiced segments could be stored along with the unprocessed target vocal signal.

The block diagram of FIG. 3 will now be described.

A block of source vocal signal samples is analyzed to determine whether they are voiced or unvoiced. The number of samples contained in this block would typically correspond to a time span of approximately 20 milliseconds. e.g., for a sample rate of 40 kHz, a 20 ms block would contain 800 samples. This analysis is repeated on a periodic or pitch-synchronous basis to obtain a current estimate of the time-varying spectral envelope. This repetition period may be of lesser time duration than the temporal extent of the block of samples, implying that successive analyses would use overlapping blocks of vocal samples.

If the block of samples are determined to represent unvoiced input, the block is not further processed and is presented to the digital to analog converter for presentation to the output speaker. If the block of samples is determined to represent voiced input, a spectral analysis is performed to obtain an estimate of the envelope of the frequency spectrum of the vocal signal.

It may be desirable or even necessary to modify the shape of the spectral envelope in some voice conversions. For example where the source and target vocal signals are of different genders, it may be desirable to shift the timbre of the source's voice by scaling the spectral envelope to more closely match the timbre of the target vocal signal. In the preferred embodiment, the optional section for modification of the spectral envelope (entitled "Modify Spectral Envelope" in FIG. 3) alters the frequency spectrum of the envelope obtained from the Spectral Analysis block. Five methods for spectral modification are contemplated.

A first method is to modify the original spectral envelope by applying a conformal mapping to the z-domain transfer function in equation (2). Conformal mapping modifies the transfer function, resulting in a new transfer function of the form:

$$H(z) = \frac{\sum_{i=0}^{P} b(i)z^{-i}}{1 + \sum_{i=1}^{P} a(i)z^{-i}} \tag{9}$$

Figure 5:
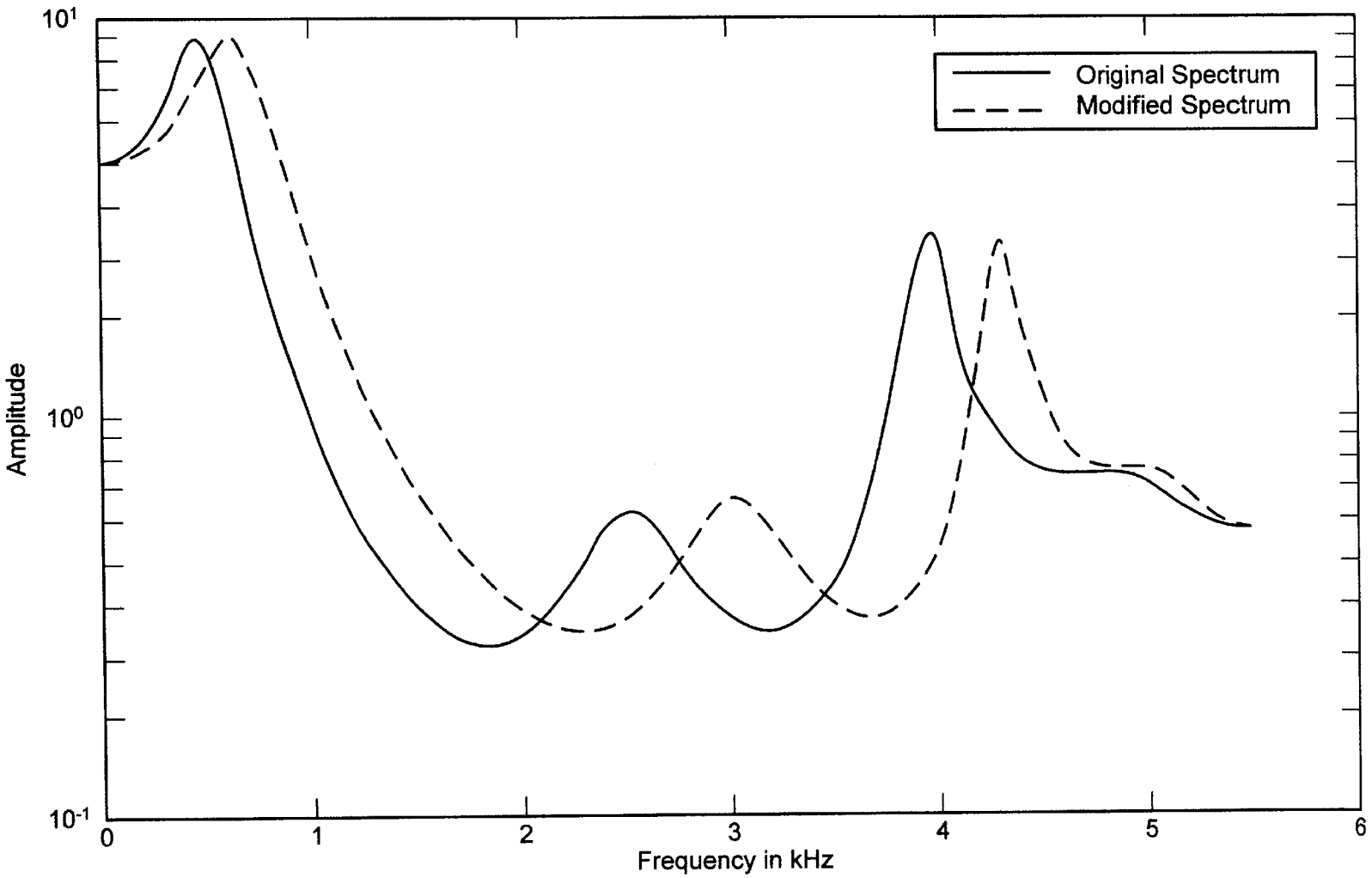
FIG. 5 is a graph illustrating the effect of conformal mapping on a spectral envelope.

Applying conformal mapping results in a modified spectral envelope, as shown in FIG. 5. Details of the technique of applying a conformal mapping to a digital filter can be found in A. Constantinides, "Spectral transformations for digital filters," Proceedings of the IEEE, vol. 117, pp. 1585–1590, August 1970. The advantage of this method is that it is unnecessary to compute the singularities of the transfer function.

A second method is to find the singularities (i.e., poles and zeros) of the digital filter transfer function, to then modify the location of any or all of these singularities, and then to use these new singularities to generate a new digital filter having the desired spectral characteristics. This second method applied to vocal signal modifications is known in the prior art.

A third method for modifying the spectral envelope, which obviates the need for a separate Modify Spectral Envelope step, is to modify the temporal extent of the blocks of vocal signals prior to the spectral analysis. This results in the spectral envelope obtained as a result of the spectral analysis being a frequency-scaled version of the unmodified spectral envelope. The relationship between time scaling and frequency scaling is described mathematically by the following property of the Fourier transform:

$$f(at) \leftrightarrow \frac{1}{|a|} F\left(\frac{jw}{a}\right) \tag{10}$$

where the left side of the equation is the time-scaled signal and the right side of the equation is the resulting frequency-scaled spectrum. For example, if the existing analysis block is 800 samples in length (representing 20 ms of the signal), an interpolation method could be used to generate 880 samples from these samples. Since the sampling rate is unchanged, this time-scales the block such that it now represents a longer time period (22 ms). By making the temporal extent longer by 10 percent, the features in the resulting spectral envelope will be reduced in frequency by 10 percent. Of the methods for modifying the spectral envelope, this method requires the least amount of computation.

A fourth method would involve manipulating a frequency-transformed representation of the signal as described in S. Seneff, System to independently modify excitation and/or spectrum of speech waveform without explicit pitch extractions, IEEE Trans. Acoustics, Speech, Signal Processing, Vol. 30, August 1982.

A fifth method is to decompose the digital filter transfer function (which may have a high order) into a number of lower-order sections. Any of these lower-order sections could then be modified using the previously-described methods.

Figure 6:
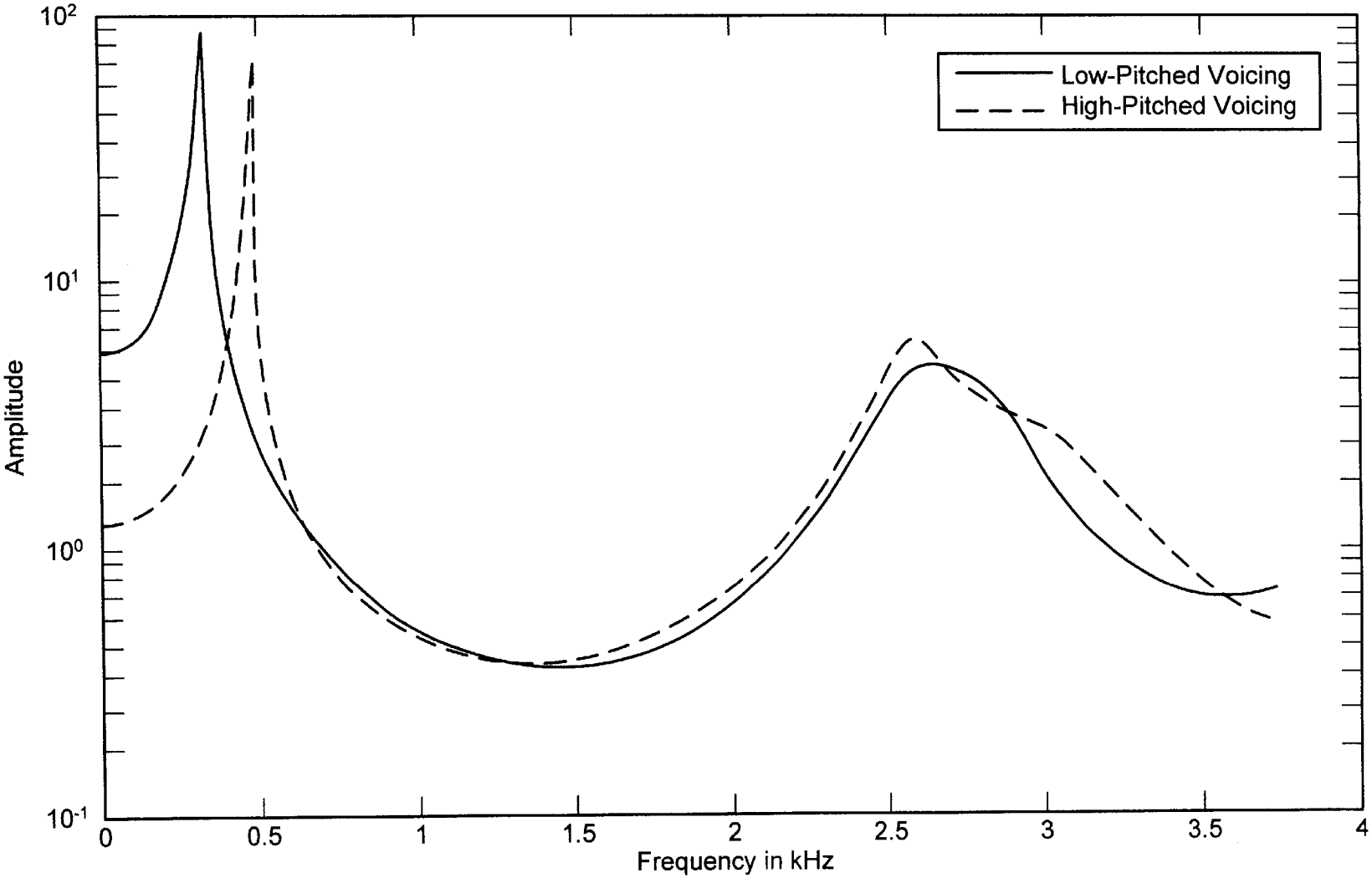
FIG. 6 is a graph illustrating the different spectral envelopes for voicing at different pitches.

A particular problem arises when the pitch of the target singer and the source singer differ by an appreciable amount, e.g. an octave, in that their respective spectral envelopes will have significant differences, especially in the low-frequency region below about 1 kHz. For example, in FIG. 6, low-pitched voicing results in a low-frequency resonance near 200 Hz whereas high-pitched voicing results in a higher-frequency resonance near 400 Hz. These differences can cause two problems:

- a reduction in low-frequency power in the transformed vocal signal; and
- amplification of system noise by a spectral peak that does not have a frequency near a harmonic of the output pitch.

These problems can be alleviated by modifying the low-frequency portion of the spectral envelope which can be accomplished by employing the aforementioned methods for modifying the spectral envelope. The low-frequency portion of the spectral envelope can be modified directly by using methods two or four.

Figure 7:
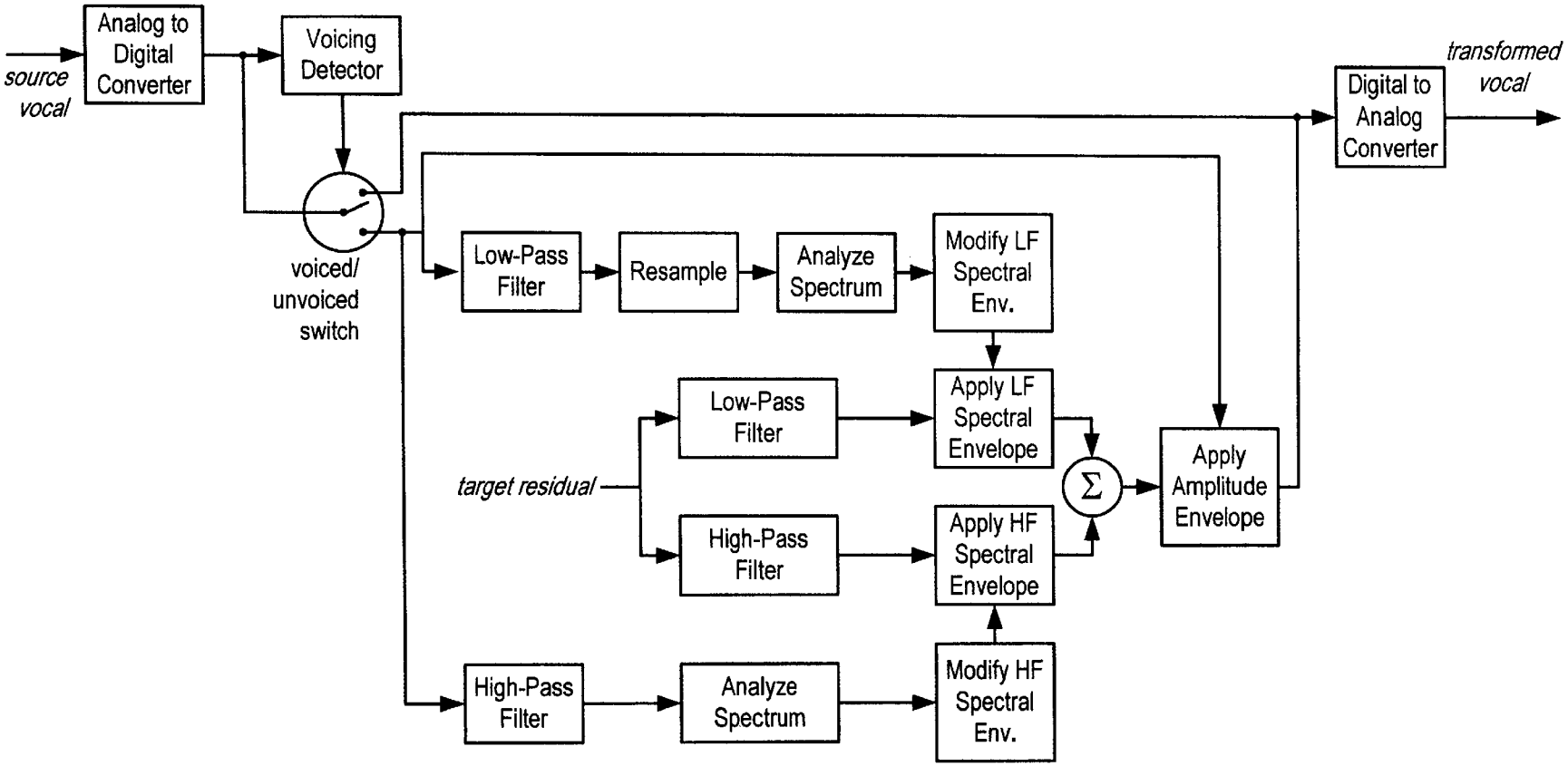
FIG. 7 is a block diagram illustrating separate modifications of the low frequency and high frequency components of the spectral envelope.

Methods one and three can also be used for this purpose if the target vocal signal is split into a low-frequency component (e.g., less than or equal to 1.5 kHz) and a high-frequency component (e.g., greater than 1.5 kHz). A separate spectral analysis can then be undertaken for both components as shown in FIG. 7. The spectral envelope from the lower-frequency analysis would then be modified in accordance to the difference in pitches or difference in the location of the spectral peaks. For example, if the target singer's pitch was 200 Hz and the source singer's pitch was 400 Hz, the unmodified source spectral envelope may have a peak near 400 Hz and, without a peak near 200 Hz, there would be a smaller gain near 200 Hz, resulting in the first problem noted above. We would therefore modify the lower-frequency envelope to move the spectral peak from 400 Hz toward 200 Hz.

The preferred embodiment modifies the low-frequency portion of the spectral envelope in the following manner:

1. The source vocal signal S(t) is lowpass filtered to create a bandlimited signal $S_L(t)$ containing only frequencies below about 1.5 kHz.

2. This bandlimited signal $S_L(t)$ is then re-sampled at about 3 kHz to create a lower-rate signal $S_D(t)$ A low-order spectral analysis (e.g., P=4) is performed on $S_D(t)$ and the direct-form filter coefficients $a_D(i)$ are computed.
3. These coefficients are modified using the conformal-mapping method to scale the spectrum in proportion to the ratio between the pitch of the target vocal signal and pitch of the source vocal signal.
4. The resulting filter is applied to the signal $S_L(t)$ (having the original sampling rate) using the technique of interpolated filtering.

Using this technique, the low-frequency and high-frequency portions of the signal are processed separately and then summed to form the output signal, as shown in FIG. 7. With reference to FIG. 7, the apparatus can be used to modify only the low-frequency spectral envelope or only the high-frequency spectral envelope. In this way, it can modify the low-frequency resonances without affecting the timbre of the high-frequency resonances or it can change only the timbre of the high-frequency resonances. It is also possible to modify both of these spectral envelopes concurrently.

Another method which can be used to alleviate the aforementioned problems regarding the low-frequency region of the spectral envelope is to increase the bandwidth of the spectral peaks. This can be accomplished by applying techniques from prior art such as:

bandwidth expansion modifying the radius of selected poles windowing the autocorrelation vector prior to computing the filter coefficients High-fidelity digital audio systems typically employ higher sampling rates than are used in speech analysis or coding systems. This is because, with speech, most of the dominant spectral components have frequencies less than 10 kHz. When using a high sampling rate with a high-fidelity system, the aforementioned order of the spectral analysis P can be reduced if the signal is split into high-frequency (e.g., greater than 10 kHz) and low-frequency (e.g. less than or equal to 10 kHz) signals by using digital filters. This low-frequency signal can then be down-sampled to a lower sampling rate before the spectral analysis and will therefore require a lower order of analysis.

Figure 8:
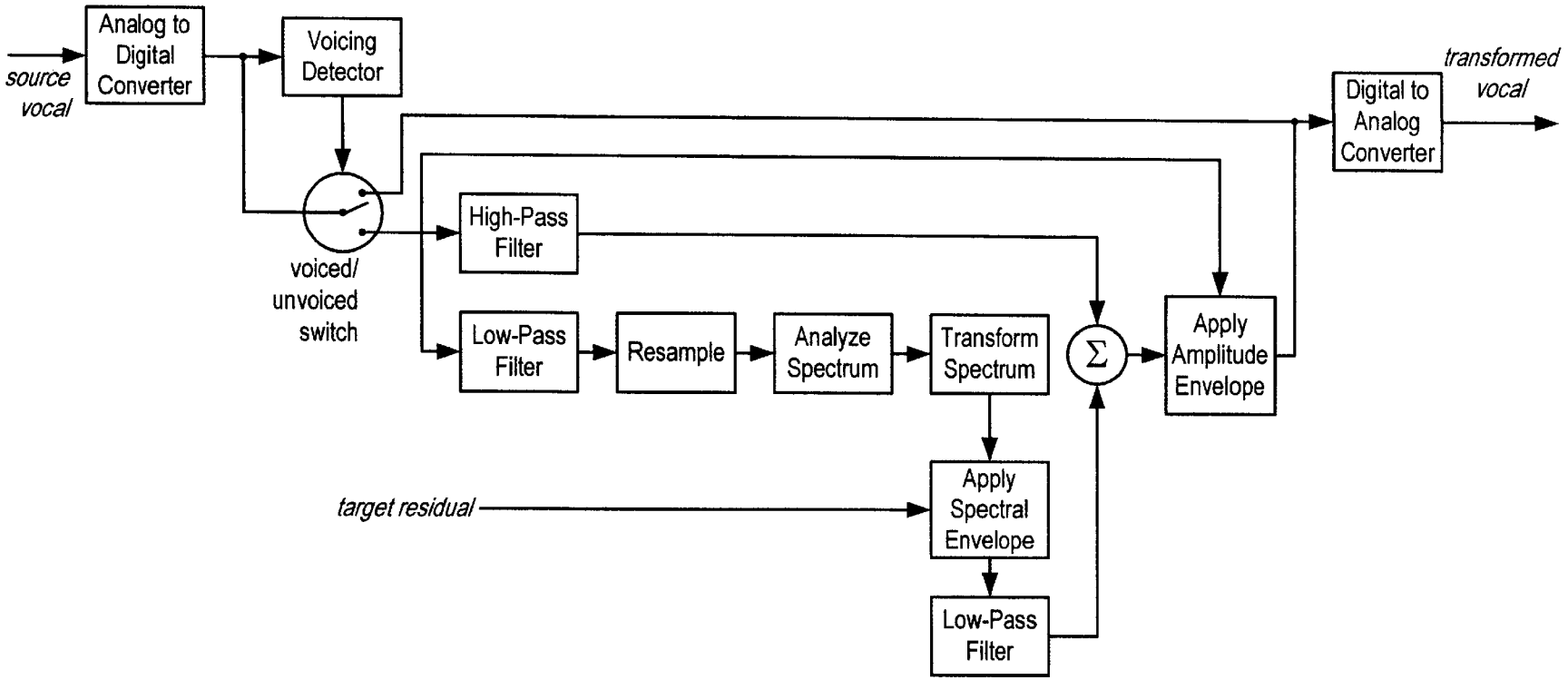
FIG. 8 is a block diagram illustrating the processing of only the voice-band portion of a signal having a high sampling rate.

The lower sampling rate and the lower order of analysis both result in reduced computational requirements. In the preferred embodiment, the input vocal signal is sampled at a high rate of over 40 kHz. The signal is then split into two equal-width frequency bands, as shown in FIG. 8. The low-frequency portion is decimated and then analyzed in order to generate the reflection coefficients $k_i$. The excitation signal is also sampled at this high rate and then filtered using an interpolated lattice filter (i.e., a lattice filter where the unit delays are replaced by two unit delays). This signal is then post-filtered by a lowpass filter to remove the spectral image of the interpolated lattice filter and gain compensation is applied. The resulting signal is the low-frequency component of the transformed vocal signal. The interpolated filtering technique is used rather than the more conventional downsample-filter-upsample method since it completely eliminates distortion due to aliasing in the resampling process. The need for an interpolated lattice filter would be obviated if the excitation signal was sampled at a lower rate matching the decimated rate. Preferably, the invention would use two different sampling rates concurrently thereby reducing the computational demands.

The final output signal is obtained by summing a gain-compensated high-frequency signal and the transformed low-frequency component. This method can be applied in conjunction with the method illustrated in FIG. 7.

The spectral envelope can therefore be modified by a plurality of methods and also through combinations of these methods. The modified spectral envelope is then used to generate a time-varying synthesis digital filter having the corresponding frequency response. In the block entitled Apply Spectral Envelope, this digital filter is applied to the target excitation signal which was generated as a result of the excitation signal extraction processing step. The preferred embodiment implements this filter using a lattice digital filter. The output of this filter is the discrete-time representation of the desired transformed vocal signal.

Figure 3:
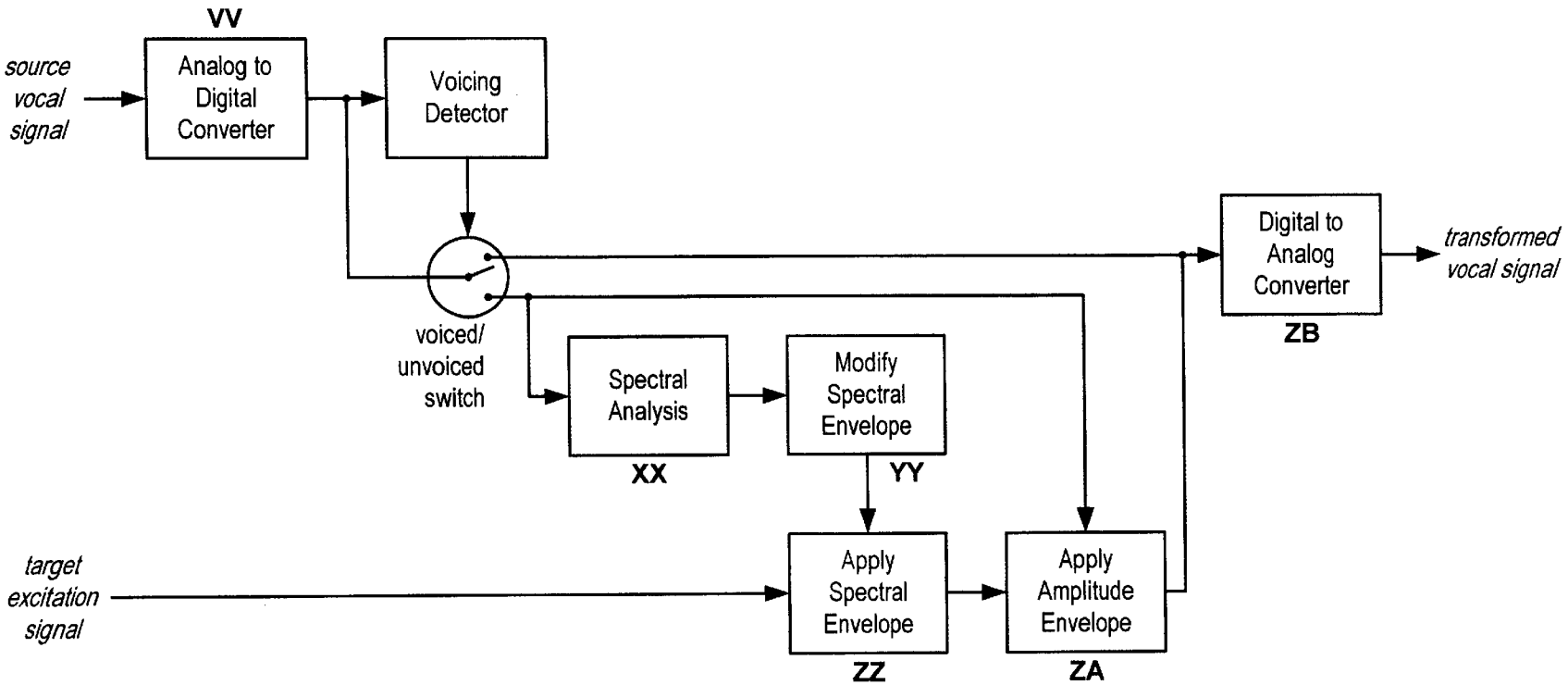
FIG. 3 is a block diagram of a vocal transformer with pitch correction.

The purpose of the block in FIG. 3 entitled Apply Amplitude Envelope is to make the amplitude of the transformed vocal signal track the amplitude of the source vocal. This block requires a number of subsidiary computations:

The level of the digitized source vocal signal $L_s$.

The level of the digitized target excitation signal $L_e$.

The level of the signal after applying the spectral envelope $L_t$.

These levels are used to compute an output amplitude level which is applied to the original signal after it has passed through the synthesis filter.

In the preferred embodiment, each level is computed using the following recursive algorithm:

The frame level $L_f(i)$ for the ith frame of 32 samples is computed as the maximum of the absolute values of the samples within the frame.

A decayed previous level is computed as $L_d(i)=0.99\,L(i-1)$.

The level is computed as $L(i)=\max\{L_f(i),L_d(i)\}$.

The amplitude envelope to be applied to the current output frame is also computed using a recursive algorithm:

Compute the unsmoothed amplitude correction $A_r(i)=L_sL_e/L_t$.

Compute the smoothed amplitude correction $A_s(i)=0.9A_s(i-1)+0.1A_r(i)$

This algorithm uses delayed values of $L_s$ and $L_e$ to compensate for processing delays within the system.

The frame-to-frame values of $A_s$ are linearly interpolated across the frames to generate a smoothly-varying amplitude envelope. Each sample from the Apply Spectral Envelope block is multiplied by this time-varying envelope.

Figure 4:
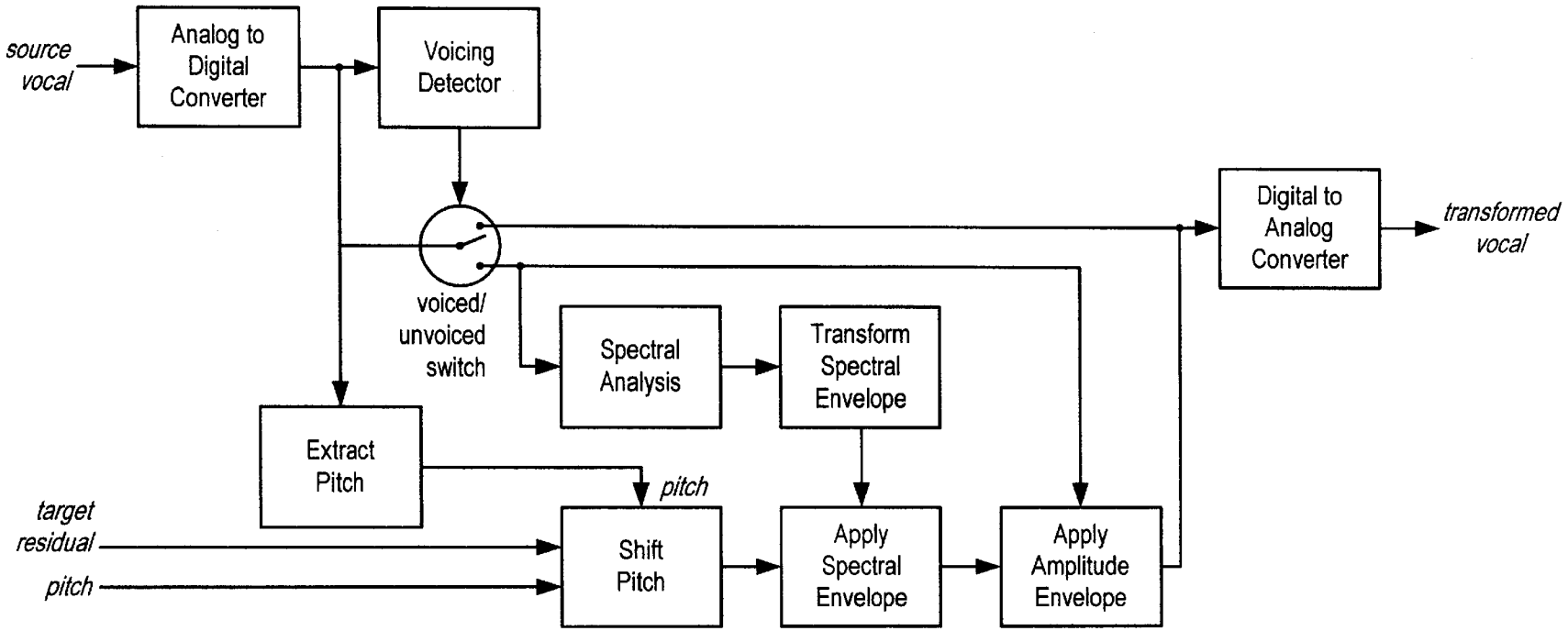
FIG. 4 is a block diagram of a vocal transformer without pitch correction (i.e. the pitch is controlled by the source singer).

FIG. 4 illustrates the case where the pitch of the source vocal signal is to be retained. In such a case, the pitch of the source vocal signal is determined. A method for doing so is disclosed in Gibson, et al., U.S. Pat. No. 4,688,464, the contents of which are incorporated herein by reference. The target excitation signal is then pitch shifted by the amount required to track the pitch of the source vocal signal before applying the modified or unmodified source spectral envelope to the excitation signal. A method of pitch shifting suitable for this purpose is disclosed in Gibson et al., U.S. Pat. No. 5,567,901, the contents of which are incorporated herein by reference. Note that while this mode of operation gives the source singer more control over the output, it can also significantly reduce the effectiveness of the transformation in cases where the character of the target singer is identified by fast varying pitch changes such as vibrato or pitch scooping. To prevent the loss of characteristic rapid pitch changes, the pitch detection process may also use long-term averaging when computing pitch shift amounts. Pitch data is averaged over ranges between 50 ms and 500 ms depending on the characteristics of the target singer. The averaging calculation is reset whenever a new note is detected. In some applications the pitch of the target excitation is shifted by a fixed amount, to accomplish a key change, and the pitch of the source singer is ignored.

It will be appreciated by those skilled in the art that variations of the preferred embodiment may also be practised without departing from the scope of the invention. It will also be appreciated that the approaches of the invention are not limited to singing voices but may equally be applied to speech.

What is claimed is:

1. A method of transforming the voice of a source individual so as to adopt characteristics of a target individual, comprising:

providing a spectral envelope derived from the voice of the source individual;

providing an excitation signal component derived from the voice of the target individual; and applying the spectral envelope from the source individual to the excitation signal component from the target individual.

2. The method according to claim 1 further comprising the step of extracting and storing the excitation signal component from the voice of the target individual.

3. The method according to claim 2 wherein the step of extracting the excitation signal is performed by flattening the spectral envelope of the target vocal signal.

4. The method according to claim 2 further comprising the step of storing said extracted excitation signal.

5. The method of claim 4 wherein said step of storing comprises storing said extracted excitation signal in compressed form.

6. The method according to claim 2 wherein the step of extracting the excitation signal comprises the steps of:

performing spectral analysis on the target vocal signal to determine the time-varying spectral envelop thereof;

using said spectral envelope to produce a time-varying filter; and using said time-varying filter to flatten said spectral envelopes.

7. The method according to claim 6 further comprising the steps of identifying voiced and unvoiced signal segments in the excitation signal component and replacing unvoiced signal segments with interpolated data from the voiced signal segments.

8. The method according to claim 7 wherein unvoiced segments in the signal are identified by comparing the parameters of the segments to thresholds selected from among the group of parameters comprising: average segment power, average low-band segment power, zero crossings per segment.

9. The method according to claim 7 wherein said step of replacing with interpolated data comprises using sinusoidal synthesis to morph between the edges of the voiced signals adjacent said silence portions.

10. The method according to claim 1 further comprising the steps of storing said excitation signal; and performing spectral analysis on a vocal signal representative of the voice of the source individual so as to determine the spectral envelope of said vocal signal.

11. The method according to claim 1 or 10 further comprising the step of transforming the spectral envelope of said vocal signal prior to applying said spectral envelope of said vocal signal to said excitation signal.

12. The method according to claim 10 further comprising the steps of:

obtaining a digital transfer function corresponding to the spectral envelope of said vocal signal;

decomposing said digital transfer function into a plurality of lower order sections; and, modifying the spectral characteristics of at least one of said lower-order sections.

13. The method according to claim 10 further comprising the step of transforming the spectral envelope by applying conformal mapping to the difference equation of the time-varying synthesis filter.

14. The method according to claim 13 wherein said vocal signal represents singing.

15. The method according to any of claim 23 or 13 further comprising the steps of splitting said vocal signal into a plurality of frequency bands and independently transforming the spectral envelopes corresponding to said bands.

16. The method according to claim 10 wherein at least one of the source individual and the target individual is a singer and further comprising the step of applying conformal mapping to the difference equation of the time-varying synthesis filter.

17. The method according to claim 1 further comprising the step of determining the pitch of the vocal signal representative of the target individual.

18. The method according to claim 17 further comprising the step of transforming the pitch of the target excitation signal to match the pitch of the source vocal signal.

19. The method according to claim 18 further comprising the step of determining the average pitch of the vocal signal of the source individual over periods of at least 50 milliseconds.

20. The method according to claim 1 further comprising the steps of:

segmenting a signal representative of the voice of said source individual into voiced and non-voiced regions;

if a given region represents voiced input, generating output by applying a spectral envelope derived from said region to said excitation signal component; and, if said given region represents unvoiced input, generating output based on said region without reference to said excitation signal component.

21. The method according to claim 1 further comprising the steps of:

transforming the spectral envelope of said second signal prior to applying said spectral envelope of said second signal to said excitation signal;

determining the amplitude envelope of the source vocal signal; and, applying said amplitude envelope to an output signal resulting from applying the spectral envelope of the voice of the source individual to an excitation signal derived from the voice of the target individual.

22. The method according to claim 1 wherein said source individual and said target individual are singers.

23. The method according to claim 1 further comprising the step of transforming the spectral envelope of said second vocal signal prior to applying said spectral envelope of said vocal signal to said excitation signal and wherein said step of transforming comprises modifying the temporal extent of a block of samples of vocal signals representative of the voice of the source individual prior to the step of performing spectral analysis.

24. The method according to claim 1 further comprising the step of splitting the vocal signal representative of the voice of the source individual into a low frequency band and a high frequency band and processing only said low frequency band according to the method of claim 1.

25. The method according to claim 24 further comprising the steps of:

decimating the low frequency portion;

analyzing the low frequency portion and generating reflection coefficients $k_i$;

sampling the excitation signal at the same rate as a rate at which the source vocal signal is sampled;

filtering the sampled excitation signal using an interpolated lattice filter;

post-filtering the excitation signal by a lowpass filter to remove the spectral image of the interpolated lattice filter; and, applying gain compensation.

26. The method according to claim 24 further comprising the steps of:

decimating the low frequency portion;

analyzing the low frequency portion and generating reflection coefficients $k_i$;

sampling the excitation signal at a rate matching the decimated rate of the low frequency portion; and, applying gain compensation.

27. The method according to claim 1 wherein said step of applying a spectral envelope derived from the voice of a source individual comprises the steps of splitting said vocal signal into plurality of frequency bands, independently transforming the spectral envelopes corresponding to said bands and applying said transformed spectral envelopes to said bands.

28. The method according to claim 27 where the steps of transforming and applying the spectral envelope in any band comprises the following steps:

resampling said signal in said band to create a resampled signal $S_D(t)$ with a lower effective sampling rate;

performing a low-order spectral analysis on $S_D(t)$ and computing the direct-form filter coefficients $a_D(i)$;

modifying the coefficients $a_D(i)$ using conformal-mapping to scale the spectrum in proportion to the ratio between the pitch of the target vocal signal and pitch of the source vocal signal; and, applying the resulting filter to the target excitation signal.

29. The method according to claim 27 where the steps of transforming and applying the spectral envelope in any band comprises the following steps:

resampling said signal in said band to create a resampled signal $S_D(t)$ with a lower effective sampling rate;

performing a temporal scaling of the said signal in said band;

performing a low-order spectral analysis on $S_D(t)$; and, applying the resulting filter to the target excitation signal.

30. The method according to claim 1 further comprising the step of extracting and storing the excitation signal component from the voice of the target individual and wherein unvoiced regions of said excitation signal component are replaced with interpolated voiced data.

31. The method according to claim 30 further comprising the step of determining a pitch contour for the excitation signal.

32. The method according to claim 30 further comprising the steps of:

segmenting the excitation signal component into analysis segments; and, determining whether each of said analysis segments represents voiced or unvoiced signal by comparing parameters of the segments to thresholds selected from among the group of parameters comprising: average segment power, average low-band segment power, zero crossings per segment.

33. The method according to claim 30 wherein said step of replacing unvoiced regions with interpolated voiced data comprises using sinusoidal synthesis to morph between the edges of voiced signal portions adjacent unvoiced regions.

34. The method according to claim 33 further comprising the use of a random pitch component.

35. The method according to claim 33 further comprising the step of storing parameters characterizing said excitation signal component, said parameters being selected from among the group comprising pitch contour and location of unvoiced regions and using said parameters in performing said step of replacing with interpolated voiced data.

36. A method of transforming the voice of a source individual so as to adopt characterstics of a target individual, comprising:

providing a vocal signal representative of the voice of a target individual;

extracting an excitation signal component of said vocal signal;

storing the excitation signal component of said vocal signal; and applying the excitation signal component of said vocal signal to a signal derived from the voice of the source individual.

37. The method according to claim 36 further comprising the step of storing said extracted excitation signal.

38. A method of transforming the voice of a source individual so as to adopt characteristics of the voices of at least two target individuals comprising:

providing a spectral envelope derived from the voice of the source individual;

providing a combined excitation signal derived from the voices of the at least two target individuals; and applying the spectral envelope from the source individual to the combined excitation signal from the at least two target individuals.

39. The method according to claim 38 further comprising the steps of:

extracting the excitation signal components from the voices of each of the target individuals;

combining the extracted excitation signal components from the voices of each of the target individuals into a combined excitation signal; and, performing spectral analysis on a vocal signal representative of the voice of the source individual so as to determine the spectral envelope of said vocal signal.

* * * * *